United States Patent [19]

Wilson

[11] 4,240,624

[45] Dec. 23, 1980

[54] HAND GRIP EXERCISE DEVICE

[76] Inventor: Bradford W. Wilson, 1642-A Coriander, Costa Mesa, Calif. 92626

[21] Appl. No.: 938,094

[22] Filed: Aug. 29, 1978

[51] Int. Cl.[3] ..... A63B 21/00

[52] U.S. Cl. ..... 272/68

[58] Field of Search ..... 272/68, 73, 67, 75 R, 272/143, 141, 135; 273/73 J, 75 R, 81 R, 81.4, 81 B, 80; D8/DIG. 8; 74/551.9; 16/110 R, 116 R; 401/7, 8, 9, 6

[56] References Cited

U.S. PATENT DOCUMENTS

| | | | |
|---|---|---|---|
| 1,817,616 | 8/1931 | Goff | 272/75 |
| 2,269,871 | 1/1942 | De Botelho | 401/8 |
| 3,611,807 | 10/1971 | Brandell | 272/68 X |
| 3,658,326 | 4/1972 | Fawick | 272/68 |
| 4,040,619 | 8/1977 | Landi | 272/68 |

*Primary Examiner*—Richard C. Pinkham
*Assistant Examiner*—William R. Browne
*Attorney, Agent, or Firm*—Gordon L. Peterson

[57] ABSTRACT

A hand grip exercise device comprising an elongated enclosure having a cavity therein. The enclosure is of a size to be grasped and squeezed by a hand of the user. The enclosure has a peripheral wall which is resiliently deformable and which can be deformed radially inwardly. Resilient deformable material is provided in the cavity so that manual deformation of the peripheral wall radially inwardly resiliently deforms the material. This increases the squeezing force which the user must apply to the peripheral wall to deform it radially inwardly.

5 Claims, 4 Drawing Figures

HAND GRIP EXERCISE DEVICE

BACKGROUND OF THE INVENTION

Hand grips are commonly used as exercise devices to strengthen the hands and forearms of the user. One common form of hand grip is generally V-shaped and includes a resilient metal spring at the apex of the "V" and two grip elements of wood or plastic attached to the opposite ends of the wire spring, respectively. The two elements are spaced apart by the wire spring and can be forced toward each other when the hand grip is squeezed in the hand of the user. One problem with this kind of hand grip is in securely attaching the opposite ends of the wire spring to the grip elements. Specifically, there is a tendency for the grip elements to work themselves free from the ends of the wire spring so that they rotate during use, and this makes the hand grip difficult to operate. In addition, hand grips of this type are often too large to be readily grasped by persons with smaller hands, particularly young adults and women.

Another form of hand grip comprises a mass of rubber or other resilient material of an appropriate size to be grasped and squeezed. This hand grip can be difficult to control while squeezing and some units are too large to be readily grasped by persons with smaller hands.

SUMMARY OF THE INVENTION

The present invention provides a distinctively different hand grip exercise device which is easy to control while squeezing and is adapted for hands of virtually any size. The hand grip includes an elongated enclosure having a cavity therein with the enclosure being of a size to be grasped and squeezed by a hand of the user. The enclosure has a peripheral wall which is resiliently deformable and which can be deformed radially inwardly.

Resilient deformable means is provided in the cavity so that manual deformation of the peripheral wall radially inwardly resiliently deforms the resilient means. This increases the squeezing force which the user must apply to the peripheral wall to deform the peripheral wall radially inwardly. Although various kinds of resilient deformable means may be used, a cellular material, such as foam rubber or foam plastic, is preferred. The density with which the foam is packed into the cavity can be varied to vary the amount of squeezing force required to deform the peripheral wall radially inwardly.

To protect the resilient means and to keep it clean, it is desirable to have the enclosure substantially completely enclose the resilient material. In a preferred construction, the peripheral wall has a passage which extends at least part way through it to define at least a portion of the cavity. The passage opens at one end of the peripheral wall. The open end of the passage can advantageously be closed by using a rigid tube and a closure member. The rigid tube is held within one end of the passage by a force fit and/or an adhesive. A closure member bears against the rigid tube to thereby permit the rigid tube to firmly hold the closure member in position. The closure member divides the cavity into first and second chambers. Because of the forces which are applied to the closure member by the resilient material when the peripheral wall is squeezed, it is important that the closure be very strong, and it has been found that this construction securely closes the open end of the passage. Although the rigid tube can hold the closure member in the passage in different ways, preferably the tube and the closure member have cooperating shoulders which serve this purpose.

To facilitate assembly, the closure member preferably includes a peripheral wall which is sized to be received within one end of the tube. This permits the closure member to be assembled into the tube before the latter is inserted into the peripheral wall of the enclosure. No adhesive between the closure member and the tube is required.

It is desirable, but not essential, to close the outer end of the tube to thereby close the second chamber. By providing a hard surface in the second chamber and an element having a hard surface within the second chamber, audible sound is produced upon contact of these relatively hard surfaces. The hand grip exercise device can now be used, for example, while jogging with the rate of the clicks produced by the hard element providing an audible indication of the speed with which the jogger is moving.

Alternatively, the open end of the peripheral wall can be closed utilizing a closure member which is retained in place by an outer closure having a peripheral flange for retaining the closure member.

The first chamber, which contains the resilient material, can be airtight if desired. In this event, the compression of the air within the first chamber adds to the force requirements for squeezing of the hand grip. Alternatively, an air passage can be provided so that the force required to deform the hand grip is a function of the resilience of the peripheral wall and the resilience of the resilient material in the first chamber.

The invention, together with further features and advantages thereof, may best be understood by reference to the following description taken in connection with the accompanying illustrative drawing.

DESCRIPTION OF THE PREFERRED EMBODIMENT

Figure 1:
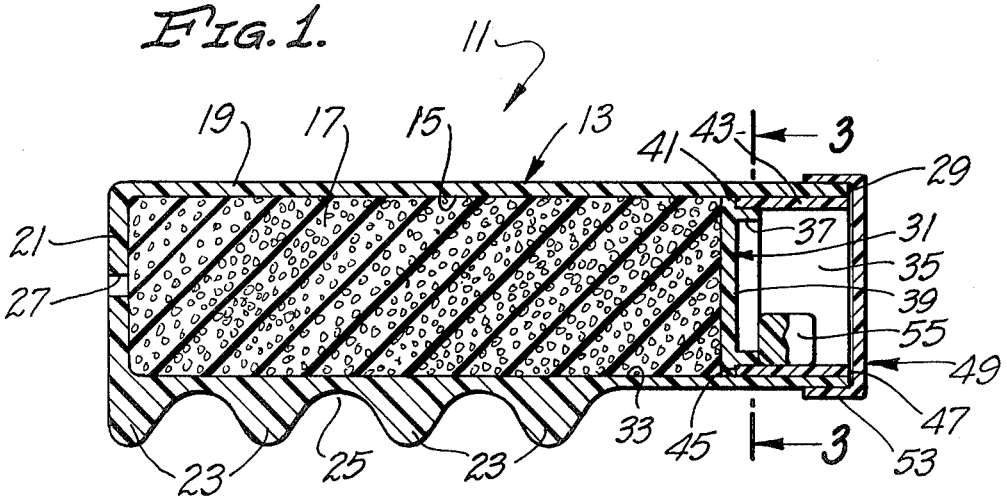
FIG. 1 is a longitudinal sectional view of a hand grip exercise device constructed in accordance with the teachings of this invention.
Figure 2:
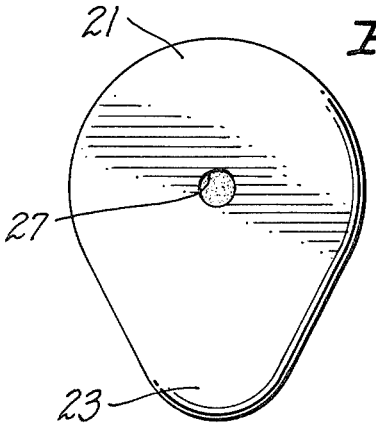
FIG. 2 is an end view of the hand grip exercise device.
Figure 3:
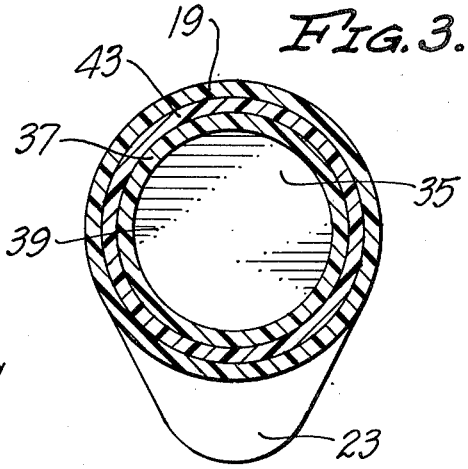
FIG. 3 is an enlarged sectional view taken generally along line 3—3 of FIG. 1.

FIG. 1 shows a hand grip exercise device 11 which includes an elongated enclosure 13 having a cavity 15 therein. Resilient deformable material 17 in the form of foam rubber completely fills the cavity 15.

The enclosure 13 includes a peripheral wall 19 and an end wall 21 integral with the peripheral wall. Although various constructions are possible, in the embodiment illustrated, a large motorcycle-type hand grip is used for the peripheral wall 19 and the end wall 21. To facilitate gripping, the peripheral wall 19 includes a plurality of radial protrusions 23 separated axially by grooves 25. The remaining exterior surface of the peripheral wall 19 may be smooth or grooved or knurled to facilitate gripping. The end wall 21 has a central aperture or air passage 27.

Except for the protrusions 23, the peripheral wall 19 is generally cylindrical and has an axial passage therein which substantially defines the periphery of the cavity 15. The cavity 15 is generally cylindrical and extends from the end wall 21 to an outer end 29 of the peripheral wall 19.

The peripheral wall 19 can be constructed of any suitable resiliently deformable material, such as rubber or plastic. The end wall 21 is also preferably constructed of a resilient deformable material.

A closure member 31 divides the cavity 15 into chambers 33 and 35. The chamber 33 is elongated and is considerably longer in the axial direction than the chamber 35. Preferably, the chamber 33 extends for a major portion of the length of the hand grip 11 and has an axial dimension which roughly corresponds to the length required for manual gripping. In the embodiment illustrated, the chamber 33 is completely closed, except for the aperture 27. The chamber 33 is completely filled with the resilient material 17. The density of the resilient material 17 and the ease with which it can be radially deformed largely determines the manual squeezing force required to deform the peripheral wall 19 radially inwardly.

The closure member 31 includes a peripheral wall 37, a transverse wall 39 and a flange or shoulder 41 forming a radial extension of the transverse wall. The closure member 31 can advantageously be constructed of a relatively rigid or somewhat resilient plastic material. In the embodiment illustrated, the transverse wall 39 is imperforate to completely separate the chambers 33 and 35.

It is important that the closure member 31 be firmly held within the cavity 15. This can be simply and inexpensively accomplished by providing a tube 43 within the outer end of the cavity 15. The tube 43 is preferably rigid and may be constructed of a rigid plastic material, such as polyvinyl chloride. In the embodiment illustrated, the tube 43 has an inner end or shoulder 45 and an outer end 47 which is substantially flush with the outer end 29 of the peripheral wall 19. The peripheral wall 37 is shorter than the tube 43 and is received within the inner end of the tube with the flange 41 bearing against the inner end 45. The tube 43 is force fit within the outer end portion of the peripheral wall 19, although an adhesive could be used in lieu of, or in addition to, the force fit.

This construction has other advantages. For example, the closure member 31 need not be adhesively attached to the tube 43 or to the peripheral wall 19. In addition, assembly of the device 11 is facilitated in that the closure member 31 can be installed on the tube 43 and the combined structure then inserted into the outer end of the peripheral wall 19.

It is desirable to close the outer end of the chamber 35, and an outer closure 49 can be provided for this purpose. Although the outer closure 49 can be a plug which is received within the tube 43, in the embodiment illustrated, the outer closure is in the form of a closure cap having an imperforate transverse wall 51 which completely closes off the outer end of the chamber 35 and a peripheral flange 53 which receives the outer end portion of the peripheral wall 19. The outer closure 49 can form a force fit with the outer end portion of the peripheral wall 19 and/or they can be adhesively attached. The outer closure 49 can be constructed, for example, of relatively hard or rigid plastic material.

A relatively hard element 55 is provided in the chamber 35. For example, the element 55 can be a mass or ball of metal or relatively hard plastic material.

In use, the user grasps the exercise device 11 with one hand with his fingers extending circumferentially around the peripheral wall 19 and lying in the grooves 25. Radial inward squeezing force can be repeatedly applied by the user to the peripheral wall 19. With each squeeze, the peripheral wall 19 and the resilient material 17 resiliently resist the squeezing action. By making the end wall 21 and the transverse wall 39, or either of them, resiliently deformable, the radial compression of the resilient material 17 tends to axially elongate the resilient material against the resilient biasing action of the end wall 21 and the transverse wall 39. This can be used to further enhance the elasticity of the device 11.

The hand grip exercise device 11 is also particularly adapted for use while jogging or doing other forms of exercise. The normal arm swinging motion while running or jogging inherently causes the hand element 55 to strike one of the hard surface of the tube 43, the closure member 31 and the outer closure 49 with each arm motion to produce an audible noise or click. The click rate can be used as an audible indication of the rate of motion of the runner.

Figure 4:
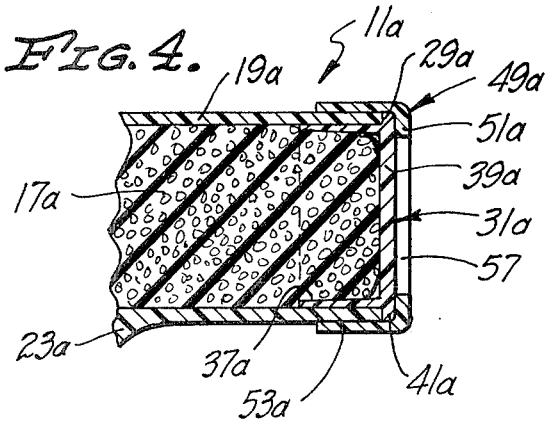
FIG. 4 is a fragmentary longitudinal sectional view of a second form of hand grip exercise device.

FIG. 4 shows a hand grip exercise device **11*a* which is identical to the hand grip exercise device 11 in all respects not shown or described herein. Portions of the hand grip exercise device 11*a* corresponding to portions of the hand grip exercise device 11** are designated by corresponding reference numerals followed by the letter "a."

The primary differences between the devices 11 and **11*a* are that the latter has no chamber 35 and no element 55, and the structure for closing the outer end of the peripheral wall 19*a* is different. More specifically, the closure member 31*a* has a peripheral wall or skirt 37*a* which is received within the outer end portion of the peripheral wall 19*a*, a transverse wall 39*a* which spans and closes the outer end of the peripheral wall 19*a* and an annular peripheral flange 41*a* which is seated against the outer end 29*a*. The closure member 31*a* is held in this position by the outer closure 49*a* which includes a flange or peripheral wall 53*a* surrounding the outer end portion of the peripheral wall 19*a*, and a transverse wall 51*a* in the form of an annular flange having a large central opening 57**.

The peripheral wall **53*a* is force fit and/or adhesively attached to the outer end portion of the peripheral wall 19*a* to firmly sandwich the flange 41*a* between the outer end 29*a* and the transverse wall 51*a*. This form of closure has been found to be very strong and capable of retaining the closure member 31*a* in position as the closure is stressed by deformation of the device 11*a*** during normal use.

Although an exemplary embodiment of the invention has been shown and described, many changes, modifications and substitutions may be made by one having ordinary skill in the art without necessarily departing from the spirit and scope of this invention.

I claim:

1. A hand grip exercise device comprising:

an elongated enclosure having a cavity therein, said enclosure being of a size to be grasped and squeezed by a hand of the user, said enclosure having a peripheral wall which is resiliently deformable and which can be deformed radially inwardly;

resilient deformable means in said cavity whereby manual deformation of the peripheral wall radially inwardly resiliently deforms said resilient means to thereby increase the squeezing force which the user must apply to the peripheral wall to deform the peripheral wall radially inwardly;

said enclosure including a hand grip including said peripheral wall, an end wall and a plurality of axially spaced radial projections, said end wall at least substantially closing one end of said peripheral wall, said enclosure including means at least substantially closing the other end of the peripheral wall; and said closing means including a closure member extending across and at least substantially closing said other end of the peripheral wall and an end cap having a peripheral wall surrounding a portion of the peripheral wall of said enclosure and a transverse wall, said transverse wall being engageable with said closure member to retain the latter.

2. A hand grip exercise device as defined in claim 1 including means defining an air passage between the cavity and the exterior of the enclosure whereby air can be expelled from the cavity when the peripheral wall of the enclosure is squeezed and resiliently deformed radially inwardly.

3. A hand grip exercise device as defined in claim 2 wherein said air passage is at least partially in said end wall.

4. A hand grip exercise device comprising:

an elongated enclosure having a cavity therein, said enclosure being of a size to be grasped and squeezed by a hand of the user, said enclosure having a peripheral wall which is resiliently deformable and which can be deformed radially inwardly;

resilient deformable means in said cavity whereby manual deformation of the peripheral wall radially inwardly resiliently deforms said resilient means to thereby increase the squeezing force which the user must apply to the peripheral wall to deform the peripheral wall radially inwardly; and said enclosure including an end wall at one end, said peripheral wall having an outer end and being open at said outer end of the enclosure, a closure member comprising a peripheral wall received within the peripheral wall of said enclosure, a transverse wall spanning and substantially closing the open end of said peripheral wall of said enclosure, and a peripheral flange engaging said outer end of said peripheral wall of said enclosure, and an outer closure including a peripheral wall surrounding a portion of said peripheral wall of said enclosure and a circumferentially extending flange for retaining said closure member.

5. A hand grip exercise device as defined in claim 16 wherein said resilient deformable means includes a resilient cellular material.

* * * * *